US005216773A

United States Patent [19]

Haakonsen

[11] Patent Number: 5,216,773

[45] Date of Patent: Jun. 8, 1993

[54] METHOD OF FORMATION AND INSTALLATION OF A FLOATING BRIDGE

[75] Inventor: Knut O. Haakonsen, Billingstad, Norway

[73] Assignee: Norwegian Contractors a.s., Stabekk, Norway

[21] Appl. No.: 712,036

[22] Filed: Jun. 7, 1991

[30] Foreign Application Priority Data

Jun. 7, 1990 [NO] Norway ..... 902532

[51] Int. Cl.[5] ..... E01D 15/14; B63B 35/44

[52] U.S. Cl. ..... 14/2.6; 114/267

[58] Field of Search ..... 14/2.6, 27; 114/267

[56] References Cited

U.S. PATENT DOCUMENTS

| | | | |
|---|---|---|---|
| 2,579,605 | 12/1951 | Odot | 114/2.6 |
| 3,022,759 | 2/1962 | McCall | 14/27 |
| 4,297,759 | 11/1981 | Soffge et al. | 14/27 X |
| 4,722,108 | 2/1988 | Fredriksson | 14/27 |
| 4,972,538 | 11/1990 | Parramore | 14/2.6 X |

FOREIGN PATENT DOCUMENTS

| | | | |
|---|---|---|---|
| 0415793 | 3/1991 | European Pat. Off. | 14/2.6 |

*Primary Examiner*—Ramon S. Britts

*Assistant Examiner*—Nancy P. Connolly

*Attorney, Agent, or Firm*—Wenderoth, Lind & Ponack

[57] ABSTRACT

A method for fabricating and installation of a floating bridge or the like provides that a bridge superstructure is supported by a number of pontoons and has opposite ends anchored to shore fundaments. Prefabricated pontoons are positioned successively at mutually spaced locations on the water surface along a center line of a part of the bridge superstructure being formed. Such pontoons are suitably ballasted. Further bridge superstructure is fabricated successively in sections in a production unit positioned on a barge or on a platform stationarily positioned by the shore. Such sections are being pushed outwardly of the production unit one after the other, with a new section being made as a continuation of a preceding section. The fabricated part of the bridge superstructure, formed of several interconnected sections which gradually are protruded from the barge or platform, is slid or pushed out onto the pontoons that are positioned one after the other, and are mounted thereon. Thereafter, when the entire bridge superstructure has been positioned on the pontoons, the thus floating bridge is floated to the particular installation site and is attached to the respective shore fundaments.

7 Claims, 2 Drawing Sheets

METHOD OF FORMATION AND INSTALLATION OF A FLOATING BRIDGE

BACKGROUND OF THE INVENTION

The present invention relates to a method of formation and installation of a floating bridge including a superstructure supported by a number of prefabricated pontoons.

Several embodiments for floating bridges are previously known. In their simplest form, such bridges have a continuous single pontoon floating in the sea and a road structure is positioned directly on top of such single pontoon. Such floating bridges may, subject to incidental natural circumstances, represent an ecological problem in that they constitute a barrier hindering the natural replacement of surface water. Further, currents and waves may create large lateral loads on such floating bridge structures.

A floating bridge therefor preferably should be made with a freely extending superstructure which is supported by separate pontoons, so that the demand for strength and buoyancy is met, while at the same time the desired replacement of surface water is not hindered by any substantial degree.

The formation and installation of such a floating bridge may, however, represent a difficult problem, in that a very large crane capacity will be required in order to lift large prefabricated sections, the minimum length of which must be equal to the distance or space between pontoons, and the pontoons must be correctly positioned along the water surface.

From traditional bridge building technology is known a method whereby a superstructure is produced continually, but sectionally, in a stationary production site that is situated ashore at one of the shore fundaments, and whereby the continuously produced superstructure is transported or pushed gradually out into the water, whereat it is supported on prefabricated mutually spaced columns mounted on the sea bottom. The superstructure is pushed out along the respective columns until the other, opposite shore fundament has been reached.

Such method for building a traditional bridge with ground support is not readily transferable to the task of building a floating bridge, especially not in locations with tidal water variations, because a production plant positioned ashore and able to carry out a pushing of the bridge superstructure out onto, for instance, floating pontoons will create and impose too large vertical movements and thereby loads on the structure as a whole. The task of ensuring a secure positioning of the floating pontoons during the transportation or pushing operation of the bridge superstructure will also cause serious problems.

SUMMARY OF THE INVENTION

The method in accordance with the present invention thus relates to the task of formation of a floating traffic bridge or the like, whereby a superstructure is supported by a number of prefabricated pontoons, and where the floating bridge is attached at ends thereof to shore fundaments. The method includes the following steps. Prefabricated pontoons are positioned successively at mutually spaced locations along a center line of an already formed part of a bridge superstructure extending out above a water surface. Such pontoons are suitably ballasted. Further bridge superstructure is fabricated successively in sections in a production unit positioned on a barge or on a platform stationarily positioned by the shore. The sections are pushed out of the production unit one after the other, with a new section being formed as a continuation of the preceding section. The fabricated part of the bridge superstructure, in the form of several interconnected sections which gradually are protruded from the barge or platform, is slid or pushed out onto readily installed pontoons which then are, one after the other, mounted to the superstructure. Thereafter, when the entire bridge superstructure has been positioned on the pontoons, the resultant floating bridge is floated out to a particular installation site and is attached to the respective shore fundaments. In a preferred embodiment in accordance with the invention, one or both end sections of the bridge superstructure are link connected about horizontal pivot axes.

The idea or aim for establishing the production plant on a barge is to eliminate all tidal water effects during construction. In connection with floating bridges in locations with nil or only small tidal water variations, for instance on lakes, one may position the production plant ashore. In practicing the invention, the pontoons will then follow during the transportation of the superstructure instead of the bridge superstructure being displaced relative to the pontoons.

The bridge superstructure according to the invention may be a trusswork steel structure or a box-shaped beam made of steel or concrete.

BRIEF DESCRIPTION OF THE DRAWINGS

An embodiment of the invention will be described in the following, with reference to the accompanying drawings, wherein.

DETAILED DESCRIPTION OF THE INVENTION

Figure 1:
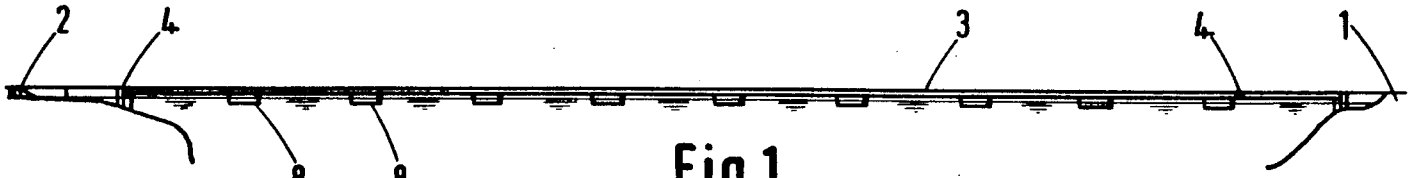
FIGS. 1 and 2 are a vertical section and a horizontal section of a floating bridge, respectively.
Figure 2:
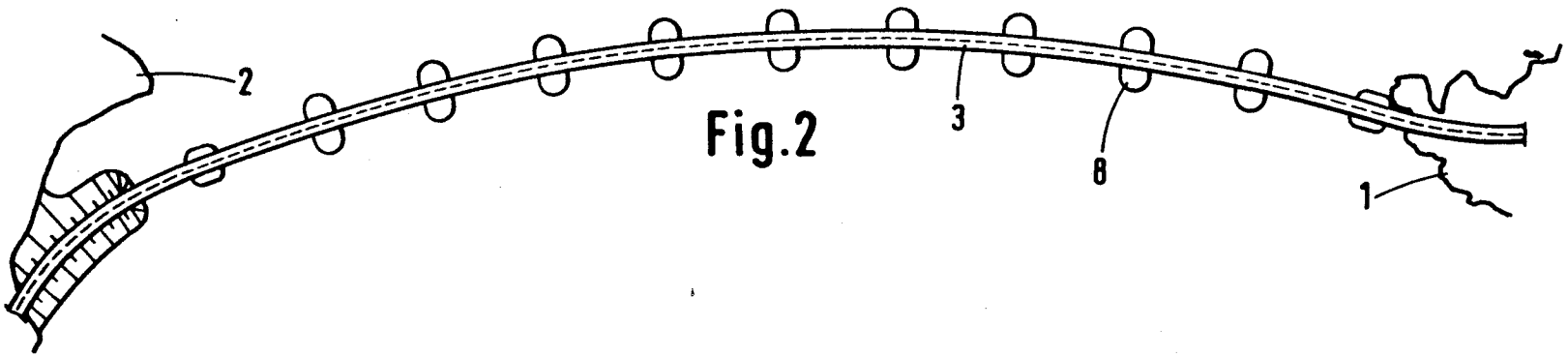

FIGS. 1 and 2 illustrate a floating bridge with pontoons 8. The floating bridge connects two shore masses 1, 2. A bridge superstructure 3 is divided up at links 4 in order to compensate for variations in water level due to tidal water, etc.

Figure 3:
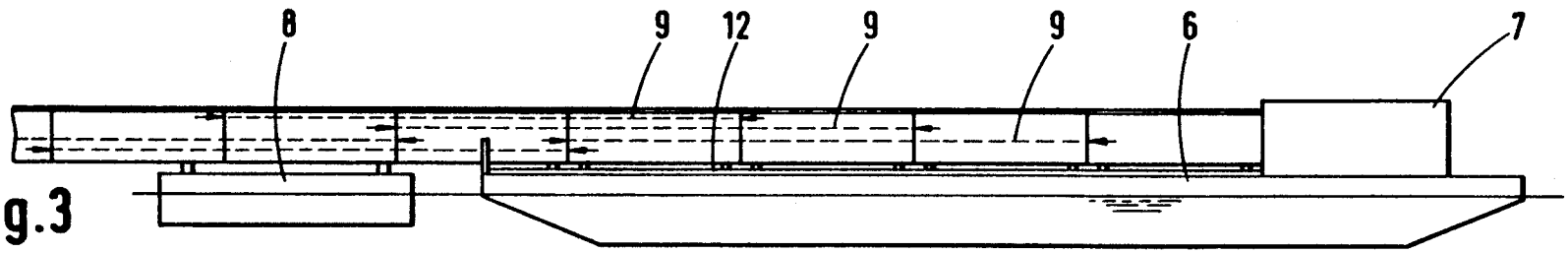
FIG. 3 is an elevation view illustrating how a superstructure of a bridge in accordance with the invention is prefabricated in a continuous length.

The bridge superstructure is, in the illustrated embodiment, being cast continuously in concrete in sections by means of formwork units 7, which are supported on a barge 6 (see FIG. 3) which is anchored at a suitable location, for instance a shielded bay having little traffic, and preferably in the vicinity of the installation site. The molding operation of the superstructure takes place as mentioned in sections in the formwork unit 7. When one section or length is ready made or hardened, it is pulled out of the formwork unit, and the molding of a new length in continuation of and interconnected with the preceding section then is started. The joint between the sections includes bridging of reinforcement bars in the casting, and continuous tubing is positioned in the casting for positioning of tension bracing cables 9 in order to provide tension casting in known fashion. The bracing cables are given a length so as to extend over three cast bridge section lengths, and they are mounted in such a manner that joints between cables are divided with one third on each division between cast lengths, thereby to provide increased safety.

The ready made cast sections slide on the deck of barge 6 in a skid guide or railing 12, and eventually an outer end of the superstructure thus being formed will extend outwardly of barge 6 over the water. Pontoons 8 are prefabricated, for instance by concrete casting, and are towed to the production site. One first pontoon is ballasted and guided to a position below the thus cantilevered outer end or part of the bridge superstructure, whereafter such pontoon is deballasted and is attached to the bridge superstructure. Consequently, as the bridge superstructure continues to be fabricated and thereafter is displaced step by step outwardly over the water, a preselected number of pontoons are mounted and attached to such continually growing bridge superstructure, which thereafter will float on the pontoons.

In locations having a substantial difference between high and low tide levels, one may with advantage equip the superstructure with links 4 in order to compensate for level variations between the shore fundaments and the floating bridge superstructure. In FIG. 1 are indicated the places whereat links 4 normally are positioned, preferably with one or two links located close to each shore fundament, and one link in the shore fundament itself. These links can be mounted during the casting of the bridge superstructure.

It shall, however, be understood that the invention is not limited to the utilization of links, since the invention also can be utilized without links.

When formation of the entire length of the bridge superstructure is completed, then such superstructure will rest on the pontoons along its entire length, except at transition elements 10 which are to be attached in the shore fundaments. Elements 10, one at each end of the superstructure, are transferred from the building barge 6 to separate barges 13. The entire bridge then is towed to the mounting site, whereat a first barge 13 is deballasted to a suitable height, so that the transition element 10 thereon and the link parts of the respective shore fundament 11 can be coupled together. In corresponding fashion, the transition element 10 at the other end of the bridge is attached to the other land fundament.

Figure 4:
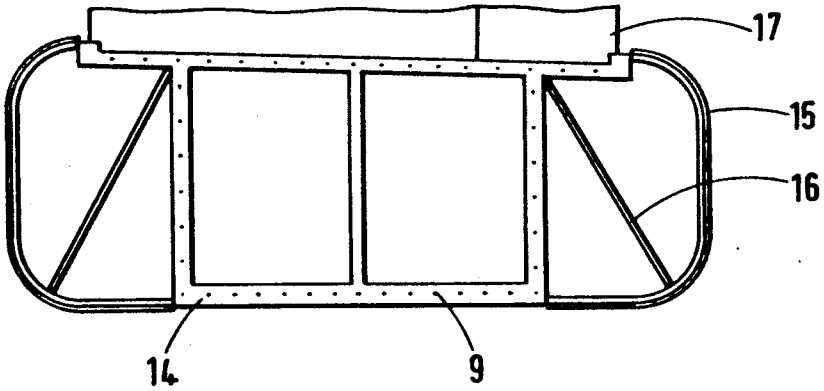
FIG. 4 is a section of a preferred profile of the superstructure.
Figure 5:
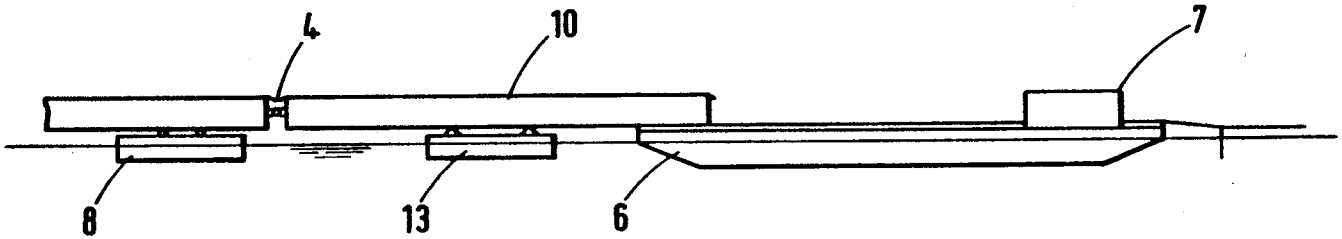
FIG. 5 is a schematic view illustrating preparation for attaching a bridge element to a shore fundament.
Figure 6:
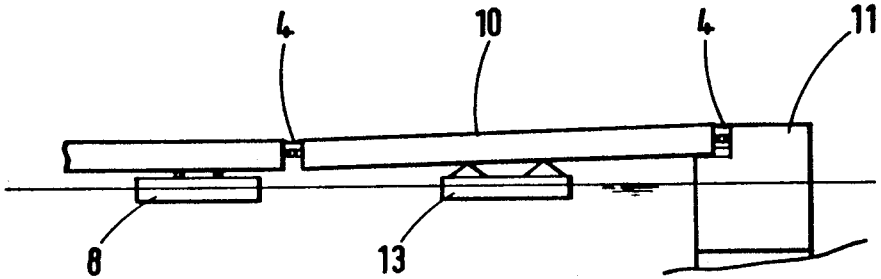
FIG. 6 is a similar view showing the bridge superstructure when attached to the shore fundaments.

A design of the superstructure which is rather suitable for the method in accordance with the invention is shown in FIG. 4. The cast part 14 has a box-shaped cross-section and is provided with longitudinal passages for bracing cables 9, and has further a laterally cantilevered top part which forms a support for a road body 17. The sides of part 14 are covered with steel plating 15 with reinforcements 16. The invention is however not limited to the shown profile of the superstructure.

In locations where a varying water level does not impose a problem, a continuous casting of the bridge superstructure in accordance with the invention may be utilized. In such case, it will not be necessary to carry out casting on a barge, since the casting operation can be carried out on a suitable platform positioned along the shore.

I claim:

1. A method for formation and for installation at a predetermined site across a body of water of a floating bridge including a superstructure supported on a plurality of pontoons and having opposite ends attached to opposed shore fundaments at said site, said method comprising:

positioning a production unit for fabricating sections of said superstructure on a production platform floating on said body of water; positioning said plurality of pontoons on said body of water;

fabricating said superstructure successively section by section at said production unit such that each succeeding said section is formed as a continuation of a preceding said section;

during said fabricating, successively discharging preceding said sections from said production unit and then from said platform;

successively mounting said sections discharged from said platform on respective said pontoons, thereby forming a continuous row of fabricated sections floated on said body of water by said pontoons, until a last said section has been fabricated and discharged, thus resulting in a bridge structure including a completed superstructure floating on said pontoons;

floating said bridge structure to said site; and connecting respective said sections at opposite ends of said bridge structure to respective said shore fundaments.

2. A method as claimed in claim 1, further comprising providing at least one of said sections at said opposite ends with capability of limited movement relative to the respective said shore fundament.

3. A method as claimed in claim 2, wherein said movement is horizontally.

4. A method as claimed in claim 2, wherein said movement is vertically.

5. A method as claimed in claim 2, comprising connecting said at least one section to an adjacent said section and to said respective shore fundament to enable relative movement therebetween about respective horizontal axes.

6. A method as claimed in claim 1, comprising prefabricating a predetermined plurality of said pontoons.

7. A method as claimed in claim 6, wherein said positioning said pontoons comprises preliminaryily mooring said pontoons in said body of water at spaced positions aligned with an intended position of discharge of said sections from said platform.

* * * * *